United States Patent [19]

Konta

[11] 4,203,603

[45] May 20, 1980

[54] PINBALL FLIPPER MECHANISM

[75] Inventor: Yukio Konta, Gardena, Calif.

[73] Assignee: Tomy Kogyo Co., Inc., Tokyo, Japan

[21] Appl. No.: 961,775

[22] Filed: Nov. 17, 1978

[51] Int. Cl.[2] ..... A63B 71/00

[52] U.S. Cl. ..... 273/129 W; 273/121 R

[58] Field of Search ..... 124/79, 1; 273/121 R, 273/121 D, 121 E, 129 A, 129 HB, 129 HA, 129 GB; 272/141

[56] References Cited

U.S. PATENT DOCUMENTS

| | | | |
|---|---|---|---|
| 1,678,527 | 7/1928 | Payne | 124/79 |
| 3,938,803 | 2/1976 | Wilmoth et al. | 272/141 |
| 3,975,019 | 8/1976 | Barlow | 273/121 A |
| 3,979,119 | 9/1976 | Cecchetti | 273/121 R |
| 4,054,287 | 10/1977 | Goldfarb et al. | 273/101 |

*Primary Examiner*—Richard C. Pinkham

*Assistant Examiner*—T. Brown

*Attorney, Agent, or Firm*—Edward D. O'Brian; K. H. Boswell

[57] ABSTRACT

A flipper mechanism for use in pinball and pinball type games can be constructed so as to utilize an elongated, linear channel serving as a bearing extending between the sides of the housing for the game and behind the playing platform employed in the game. Two plungers are located within the channel and are normally biased away from one another by a spring located within the channel between the plungers. Each plunger is connected to an arm of a bell crank lever by means of a pin and slot sliding connection. An arm of each bell crank lever is pivotally mounted so as to be capable of being pivoted when its associated plunger is pushed against the spring. The other arm of each bell crank lever is located above the playing platform so as to serve as a flipper as its associated plunger is pushed.

4 Claims, 3 Drawing Figures

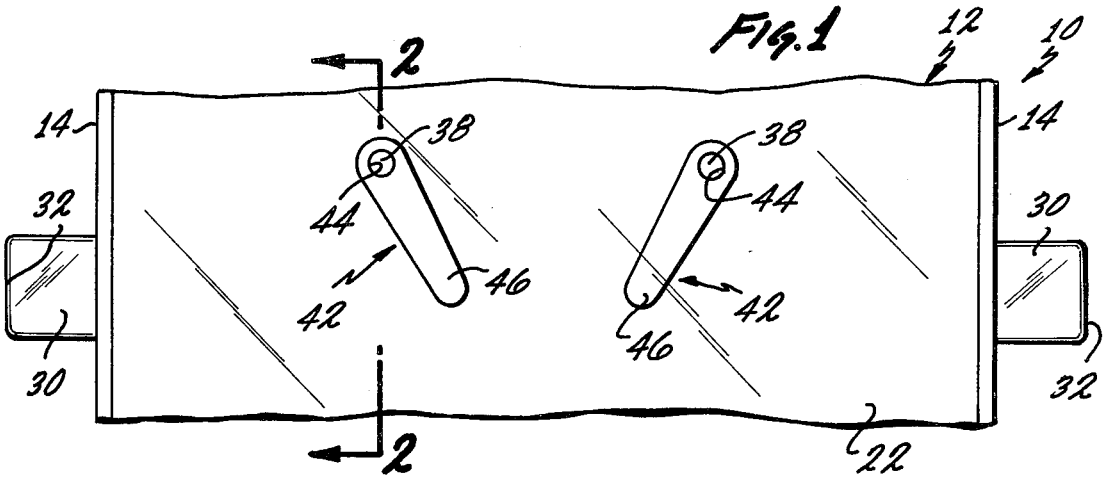
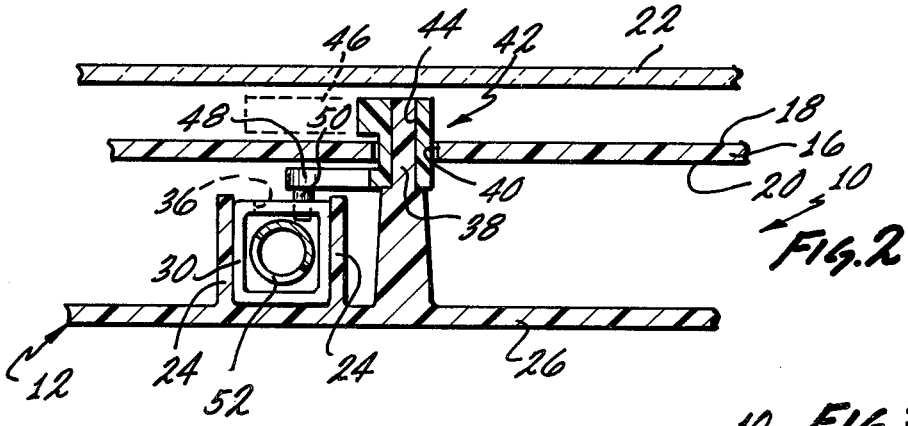
FIG. 2
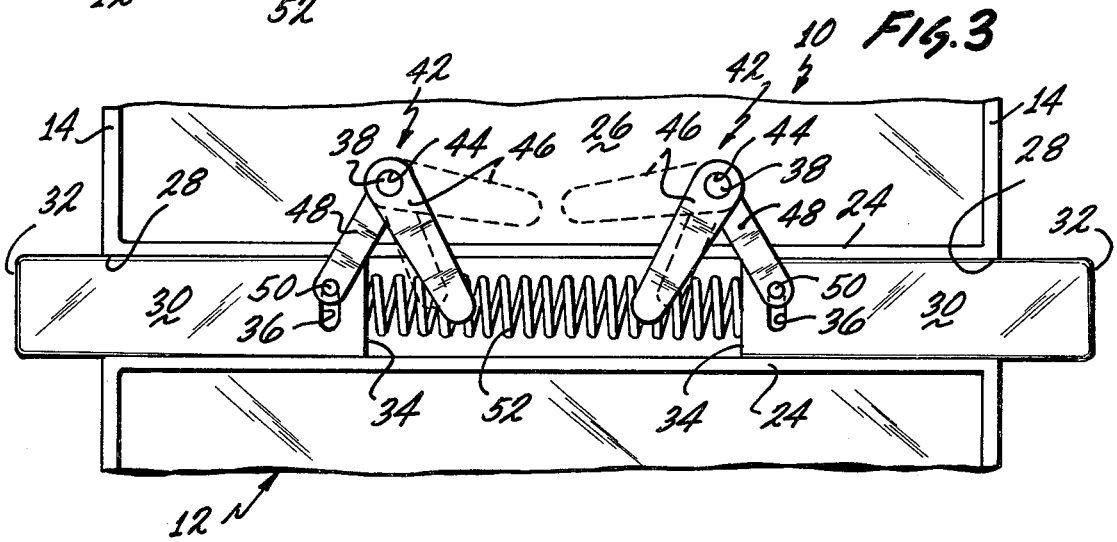

PINBALL FLIPPER MECHANISM

BACKGROUND OF THE INVENTION

The invention set forth in this specification pertains to a new and improved pinball flipper mechanism.

Pinball and pinball type games are normally constructed so that as a ball moves along a playing surface or platform it is deflected by contact with one or more objects. Normally at least some of such objects serve to indicate a score as a result of being contacted by a ball in this type of game. In order to increase interest in pinball and pinball type games it is commonplace to utilize so-called "flippers" for the purpose of hitting a ball as a ball moves so as to deflect the ball in such a manner that it can repeatedly hit one or more objects on the playing surface. These flippers and actuated by an individual playing a pinball or pinball type game through the use of an appropriate mechanism. This provides a certain amount of player participation in what otherwise is essentially a purely mechanical type of game.

The flipper mechanisms used in prior pinball and pinball type games have been constructed in a number of different manners. In general, such prior mechanisms are considered to have been comparatively expensive and comparatively unreliable from a mechanical standpoint. There are, of course, exceptions to this, but such exceptions are not considered to be significant enough to require being discussed in this discussion. As a result of the noted problem frequently comparatively small, inexpensive toy-type pinball games have been constructed without flipper mechanisms. It is considered this is undesirable since the greater the relationship between small, inexpensive toy pinball games to larger games such as are commonly utilized in arcades and the like, the greater the acceptability of such small, inexpensive toy-type pinball games.

One factor which is particularly pertinent here is related to the fact that the flipper mechanisms in such larger or adult type games are normally located so as to be capable of being actuated from adjacent to the sides of such games through the use of appropriate structures capable of being manually engaged mounted on such sides. Mechanical flipper mechanisms such as have been proposed for use in small, inexpensive toy-type pinball games have not normally been constructed in such a manner as to permit such side actuation as in larger, more expensive arcade-type pinball and pinball type games.

SUMMARY OF THE INVENTION

As a result of these considerations it is considered there is a need for a new and improved pinball flipper mechanism. A broad objective of this invention is to fulfill this need. More specifically the invention is intended to provide a pinball flipper mechanism which can be easily and conveniently constructed at a comparatively nominal cost and which is mechanically quite reliable and capable of operating satisfactorily even after being accorded a normal amount of physical abuse by children. The invention is also intended to provide a pinball flipper mechanism of a mechanical character which can be operated at the sides of a pinball or pinball type game.

In accordance with this invention these various objectives of the invention are achieved by providing a pinball flipper mechanism which includes: a housing, a playing platform located within the housing, an elongated bearing having an end exposed at one side of the housing located to the rear of the playing platform, a plunger slidably mounted within the bearing, this plunger having an end located so as to be accessible from the exterior of the housing and another end located adjacent to the rear of the platform, an opening extending through the platform, a bell crank lever positioned with its apex of the bell crank lever for rotation about an axis which is perpendicular to the front of the platform and pin and slot connection means connecting the other arm of the lever with the plunger so that as the accessible end is manipulated to move the plunger within the bearing the pin and slot connection means converts the movement of the plunger into rotation of the bell crank lever in a plane generally parallel to the front of the platform.

BRIEF DESCRIPTION OF THE DRAWING

Because of the nature of the invention it is considered that it is best more fully described with reference to the accompanying drawing in which:

FIG. 1 is a top plan view of a part of a pinball game constructed so as to utilize a presently preferred embodiment or form of a flipper mechanism in accordance with this invention;

FIG. 2 is a partial cross-sectional view taken at line 2—2 of FIG. 1; and

FIG. 3 is a top plan view with the playing platform and transparent cover employed in the pinball game removed.

The flipper mechanism illustrated in the drawing and described in this specification is constructed so as to utilize the concepts or principles of the invention set forth and defined in the appended claims forming a part of this specification. It will be recognized that these concepts or principles can be embodied within a variety of somewhat differently constructed and/or differently appearing structures through the use or exercise of routine engineering skill such as is commonly encountered in the toy industry.

DETAILED DESCRIPTION

In the drawing there is only shown the part of a pinball game 10 which contains a complete flipper mechanism (not separately numbered) in accordance with this invention. This game 10 includes a conventional housing 12 constructed so as to have opposed sides 14. The housing 12 supports and is attached to a playing platform 16 having a front 18 and a rear 20. A conventional transparent cover 22 is also supported by the housing 12 so as to extend over the front 18 of the platform 16 in such a manner as to accommodate ball movement on the front 18 of the platform 16 and in such a manner as to accommodate pins, bumpers and the like (not shown) such as are commonly employed in connection with a platform such as the platform 16.

The housing 12 is constructed so as to include spaced, parallel walls 24 extending upwardly from the bottom 26 of the housing 12 to immediately adjacent to the rear 20 of the platform 16. These walls 24 and the bottom 26 define an elongated bearing (not separately numbered) of a rectilinear or non-round configuration extending completely between the sides 14. Openings 28 are provided in the sides 14 at the ends of the space (not separately numbered) between the walls 24 and the bottom 26 and at the rear 20 of the platform 16.

Elongated non-round plungers 30 having a cross-sectional configuration corresponding to the space between the walls 24 and the bottom 26 at the rear 20 of the platform 18 are located as shown so as to each have an end 32 extending through an opening 28 a short distance outwardly from the side 14. These plungers 32 also have other ends 34 which are spaced from one another adjacent to the rear 20 of the platform 16. Slots 36 are provided in the plungers 30 so as to extend transverse to the walls 24.

Pivot pins 38 are provided on the housing 12 so as to extend upwardly from the bottom 26 through openings 40 in the platform 16. These pivot pins 38 are located adjacent to but are spaced from the plungers 30. Each of these pivot pins 38 carries a bell crank lever 42. Each of the bell crank levers 42 is provided with an opening 44 at its apex which extends over its associated pivot pin 38 so as to achieve a conventional rotatable mounting. Each of the bell crank levers 42 also includes an elongated arm 46 positioned so as to extend over the front 18 of the platform 16. Each of the bell crank levers 42 also includes another arm 48 located adjacent to the rear 20 of the platform 16 so as to normally be hidden from view.

These other arms 48 carry pins 50 extending parallel to the pivot pins 38. Each of the pins 50 fits within one of the slots 36 in one of the plungers 30 so as establish a sliding pin and slot type of mechanical connection. As a result of this connection when a plunger 30 linearly moves with respect to a side 14, such motion will be transmitted to the bell crank lever 42 resulting in rotation of the arm 46 of such lever 42 corresponding to the normal flipper movement in a conventional pinball or pinball type game. Because of the non-round configuration of the plungers 30 and the walls 24 and the bottom 26 the pin and slot connection employed will be operative at all times since it is impossible for the plungers 30 to rotate as they are held generally between the walls 24.

The pins 50 and the slots 36 not only translate motion but in addition they serve another important function. Because of the geometry of the parts employed the pins 50 fit within the slots 36 so as to limit or block movement of the plunger 30 generally outwardly of the sides 14 of the housing 12. This serves to hold the plungers 30 in an operative position. Preferably a small coil spring 52 is located between the walls 24 adjacent to the rear 20 of the platform 16 under compression between the two plungers 30. This spring 52 always serves to bias the plungers 30 outwardly from the sides 14 to positions in which they conveniently can be manipulated by being pressed inwardly so as to cause rotation of the bell crank levers 42. With this structure one spring serves to bias both of the levers 30. This is considered to achieve a certain economy of manufacture.

I claim:

1. A pinball flipper mechanism which includes:

a housing having sides and a top, a playing platform located within said housing, said platform having a top visible from the exterior of said housing and a bottom, an elongated bearing extending between said sides of said housing, said bearing having ends exposed at said sides of said housing, said bearing being located adjacent and below said bottom of said playing platform, two plungers, each of said plungers being slidably mounted within said bearing, each of said plungers having an accessible end located so as to be accessible from the exterior of said housing at a side thereof, each of said plungers having an interior end located within said bearing adjacent to the bottom of said platform, said interior ends within said bearing being spaced from one another, a single spring means located within said bearing between said adjacent ends of said plungers for biasing said plungers so that they extend outwardly from said sides of said housing, two openings extending through and substantially perpendicular to said platform adjacent to said bearing, said openings being spaced from one another, two bell crank levers, each of said bell crank levers having a centrally located apex and first and second elongated arms, said first elongated arm serving as a flipper and being located adjacent said top of said platform and said second arm being located adjacent said bottom of said platform, said arms extending from said apex, each of said bell crank levers being positioned so that its apex extends through one of said openings two pivot means, one of said pivot means supporting the apex of one of said levers for rotation about an axis extending through its apex which is perpendicular to said platform, the other of said pivot means supporting the apex of the other of said levers for rotation about an axis extending through its apex which is perpendicular to said platform, and two separate pin and slot sliding connection means, a pin and slot sliding connection means connecting each of said second arms with one of said plungers, said pin and slot sliding connection means permitting said accessible ends of said plungers to be moved generally toward said sides of said housing so as to cause rotation of said bell crank levers.

2. A pinball flipper mechanism as claimed in claim 1 wherein:

each of said pin and slot sliding connection means serves to limit movement of its associated plunger out of said bearing.

3. A pinball flipper mechanism as claimed in claim 1 wherein:

each of said pin and slot sliding connection means comprises a slot located in one of said plungers and a pin located on one of said second arms remote from said apex.

4. A pinball flipper mechanism as claimed in claims 1, 2 or 3 wherein:

said bearing is linear and having a non-round cross-sectional configuration, and each of said plungers being shaped so as to have a cross-sectional configurations corresponding to the cross-sectional configuration of said bearing.

* * * * *